PTU20 XR 4,342,031

United States Patent [19]

Lapeyre

[11] 4,342,031

[45] * Jul. 27, 1982

[54] LIQUID CRYSTAL AND NUMERICAL DISPLAY DEVICES

[75] Inventor: James M. Lapeyre, New Orleans, La.

[73] Assignee: The Laitram Corporation, Harahan, La.

[ * ] Notice: The portion of the term of this patent subsequent to Mar. 18, 1992, has been disclaimed.

[21] Appl. No.: 112,198

[22] Filed: Jan. 15, 1980

[51] Int. Cl.[3] ..... G09G 3/04

[52] U.S. Cl. ..... 340/756; 340/758; 340/762; 340/765

[58] Field of Search ..... 340/756–765

[56] References Cited

U.S. PATENT DOCUMENTS

| | | | |
|---|---|---|---|
| Re. 29,033 | 11/1976 | Lapeyre | 340/762 |
| 849,226 | 4/1907 | Garrett | 340/809 |
| 2,064,964 | 12/1936 | Wickes | 340/780 |
| 3,076,187 | 1/1963 | Bichell et al. | 340/378.2 |
| 3,368,290 | 2/1968 | Loeb | 340/752 |
| 3,872,463 | 3/1975 | Lapeyre | 340/762 |
| 4,112,424 | 9/1978 | Lapeyre | 340/762 |

*Primary Examiner*—Marshall M. Curtis
*Attorney, Agent, or Firm*—Laurence R. Brown

[57] ABSTRACT

Liquid crystal, plasma cathode glow type or other materials visibly changeable by electrical actuation are provided with a set of generally circular shaped electrodes registering on opposite sides of a display panel and connected by a set of conductors serves to select decimal and alphameric numbers and symbols from subsets of as few as twelve side-by-side element positions. The character presentation in a pleasing and flexible style such as scroll is feasible because the elements form substantially equilateral triangles with adjacent elements.

Simplified electronic coding and switching circuits are possible by use of fewer element areas in a set to form characters. The arrays may be continuously energized with a thirteen lead version with individual conductors to each element or may be cyclically pulsed with a four by four, five by three, etc. matrix conductor pattern of wires on opposite sides of the material.

Auxiliary indication is visible through the crystal transparency and contrast-visibility of liquid crystal embodiments is enhanced by techniques including circular element shapes in a side-by-side array. Ease of manufacturing is afforded because of few conductors necessary and the elimination of thin conductor patterns and long conductors meandering over circuitous paths.

25 Claims, 18 Drawing Figures

LIQUID CRYSTAL AND NUMERICAL DISPLAY DEVICES

TECHNICAL FIELD

This invention relates to electrically actuated digital display systems for visually presenting recognizable characters, and more particularly it relates to the construction of display panels with specialized patterns of discrete visibly changeable electrically actuated elements placed in side-by-side relationship having particular advantage with liquid crystal and plasma type displays and corresponding wiring patterns providing a selection of subsets of the elements.

BACKGROUND ART

This invention deals with display systems for visually reproducing characters such as Arabic decimal numerals, alphameric characters and various symbols, and the specific construction of the displays and the display units used in the systems.

There are known systems using various types of display units such as (1) electric lamp actuated systems represented by U.S. Pat. No. 3,622,224—J. J. Wysocki et al.—Nov. 23, 1971, (2) light emitting diode systems as shown in U.S. Pat. No. 3,840,873—S. Usui—Oct. 8, 1974, (3) liquid crystal display systems as shown in U.S. Pat. No. 3,613,351—R. S. Walton—filed May 13, 1969 or U.S. Pat. No. 3,975,085—T. Yamada et al.—Aug. 17, 1976, and (4) plasma type display systems as shown in U.S. Pat. Nos. 3,989,981—J. Ogle et al.—Nov. 2, 1976; 3,989,974—H. Tottori et al.—Nov. 2, 1976; and 3,890,609—R. Sasaki et al.—June 17, 1975.

Particularly in battery operated systems and other systems requiring low energy consumption, the liquid crystal display elements are advantageous. These crystal displays are highly developed with various driving systems and crystal element panel wiring layouts. Thus, a rectangular wiring matrix of crossed conductors on opposite sides of the crystal is shown in U.S. Pat. No. 3,410,999—J. L. Fergason et al.—Nov. 12, 1968 and in U.S. Pat. No. 3,982,239—S. Sherr—Sept. 21, 1976. Other crystal element wiring patterns and shapes are known such as when a color picture of a bottle is presented in U.S. Pat. No. 3,576,364—L. A. Zanoal—Apr. 27, 1971, and with a common solid conductor on one side of the crystal as in U.S. Pat. No. 3,600,060—D. C. Kettering et al.—Aug 17, 1971. Special character display patterns are also known such as a "FIG. 8 matrix" in U.S. Pat. No. 4,142,182—A. R. Kmetz—Feb. 27, 1979 or an array of slot-like elements in an array with some isolated and some interconnected as shown in U.S. Pat. No. 4,121,202—W. J. M. Gissane—Oct. 17, 1978.

Also the transparancy characteristics of liquid crystal displays permitting see through is recognized in U.S. Pat. No. 3,703,329—J. A. Castellano—Nov. 21, 1972 and U.S. Pat. No. 3,903,519—B. Zega—Sept. 2, 1975 for example.

The need to simplify electronic switching and selection systems by special patterns of discrete and separate display element areas is recognized by J. M. Lapeyre in U.S. Pat. Nos. 4,112,424—Sept. 5, 1978 and 3,872,463—Mar. 18, 1975, where respectively fourteen and sixteen element areas have subsets selectable to display Arabic decimal numerals 0–9. Also advantages of a slanted off-vertical array of element positions in producing visibly legible characters are set forth. However, there remains some fundamental problems with display systems that are not solved by the prior art. Thus, for example, switching and control systems have remained complex in most instances, particularly where battery life is saved by time shared pulsing of display devices at a rate not discernable by the human eye and therefore giving the appearance of continuous energization.

When the display panel is liquid crystal, then the contrast is limited and when elements become small they are difficult to distinguish. The display is further complicated by difficult manufacturing techniques, handling a myriad of wires, many being so thin that reliability is a problem, and being limited to patterns not permitting common overlap areas on both sides of the crystal, which might display non selected patterns or "noise". Also definition of characters in an esthetically pleasing pattern easily seen is a problem particularly with liquid crystal displays.

In displays including cathode glow plasma type displays, there are strict limitations placed upon wiring layouts and positions of elements to prevent overlap of wires on opposite sides of the active materials causing unwanted visual changes. Sometimes areas outside desired character element areas are masked by painting, etc.

It is therefore a general object of this invention to provide improved display systems which resolve these prior art deficiencies.

One special object of the invention is to provide display systems with advantageous electrode patterns.

More specifically, it is an object of the invention to produce display systems with simplified energization circuitry legible and pleasing visual display of selected characters, and compatible with energy saving techniques and liquid crystal display elements.

Other features, objectives and advantages will be found throughout the following description, drawings and claims.

DETAILED DESCRIPTION OF PREFERRED EMBODIMENTS OF THE INVENTION

Although other display devices may be used both crystal and plasma display materials have advantages in accordance with features of this invention, which provides a time sharing mode of operation. The time sharing mode is a distinct advantage in keeping operating power low as in battery operated systems, for example. However, this power advantage may be lost if electronic coding and switching circuits for operating the display are complex. Thus, simplified display element patterns with correspondingly simplified coding and switching systems are set forth which minimize external switching requirements.

A liquid crystal or plasma display medium generally has two sets of transparent conductor electrodes placed on glass plates or panels on opposite sides of the medium so that a potential difference across the conductors will change the visible state of the medium between those conductors. Thus, any conductor overlap areas of the two electrodes will produce a change of visible state whenever a potential is applied and to avoid unwanted display activation, there is a critical restriction on the wiring patterns that may be used. Also it is desirable to use as much of the entire display area as possible with elemental display areas made visible with a set of electrode pairs on opposite sides of the medium, which can be selected in subsets to form desired characters in order to produce a substantially continuous character line and good visibility. This is particularly important in the case of liquid crystal displays to overcome the inherent lower contrast a liquid crystal gives in some lower light environments than a display lighted by a lamp or plasma cathode glow. An array of rectilinear shaped elements formed between sets of parallel matrix conductors on the two opposite crystal faces makes character shape, lines and contiguity hard to recognize and not artistically pleasing.

Figure 1A:
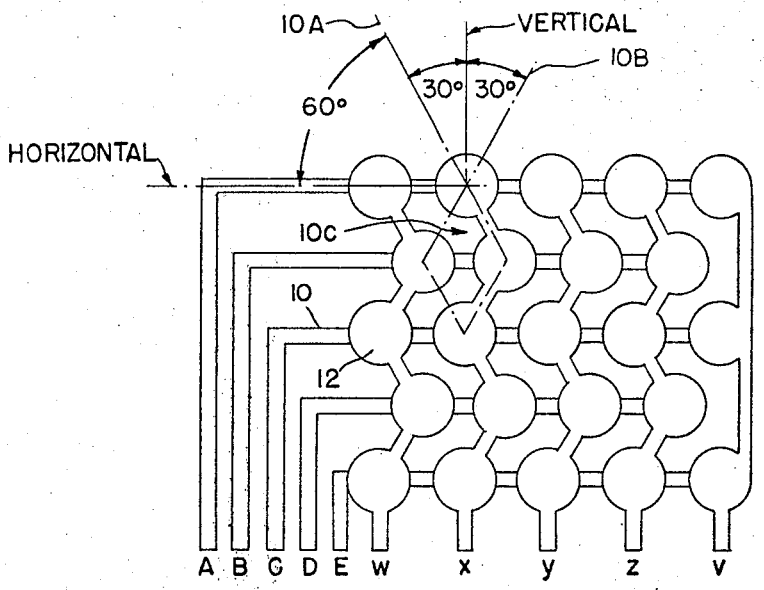
FIG. 1*a* is a diagrammatic sketch of conductor matrix patterns suitable for a matrixed conductor time shared selection of each coordinate of a set of display element electrodes of circular shape arranged in a side-by-side array on opposite sides of a visibly changeable display medium.
Figure 1B:
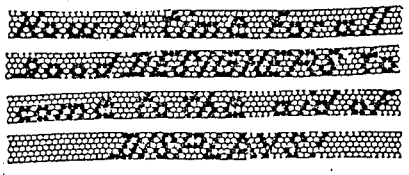
FIG. 1*b* is a sketch of typical display messages within the alphameric capacity of the matrix pattern of FIG. 1A producing scroll type upper and lower case readout.

Thus, as seen in FIGS. 1*a* and 1*b* the parallel matrix conductors a, b, c, d, e (behind the active material) and w, x, y, z (in front of the active material) arranged on opposite sides of the crystal or plasma producing gaseous medium form common overlapping patterns only at the circular electrode areas of the set of 23 element areas shown in a side-by-side interlaced relationship to present an artistically pleasing array of sub-elements forming distinctive character shapes. The conductors 10 are relatively thin as compared with the diameter of circular electrodes 12, and when the two coordinate sets of 5 by 5 matrix conductors a, b, c, d, e and v, w, x, y, z disposed on opposite sides of the visually activated material are registered, all the circular electrodes 12 on opposite sides of the crystal will be commonly overlapped and none of the thinner conductor areas 10 to avoid unwanted visible areas. This feature holds true for the various embodiments shown herein. With this array of twenty-three circular elements a pleasing alphabetic scroll type of display characters can be formed as shown in FIG. 1*b*. Each coordinate sub-element at coordinates aw, bw, etc, may be individually located and energized by a potential at the intersecting matrix leads such as a-w, b-w, etc. of the 5 by 5 matrix wire array. A variation of this array in a 4 by 4 matrix a, b, c, d; w, x, y, z, for example, provides a total combination of sixteen selections.

Note that also this invention provides for the matrix element rows 10A, 10B to be disposed at an angle of the order of 60° from horizontal to provide a particular dot element relationship. Thus, as seen from the triangular sketch 10C electrodes 12 are disposed side-by-side so that they can form slanted lines at the 60° angle. Thus, the arrangement of each electrode is in a preferably isosceles triangle pattern with two adjacent electrodes, thereby permitting the pleasing scroll shaped letters of FIG. 1*b* and much more versatility in forming extra symbols and pleasant looking decimal numbers, etc.

Figure 9:
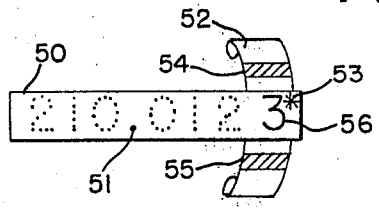
FIG. 9 is a diagrammatic representation of a multiple digit crystal display panel employing auxiliary display means visible through the transparency of the crystal panel.

Note in the present format the use of zig-zag conductor lines v, w, x, y, z provides this desired triangular dot arrangement with the dots in the rows interlaced and serves to pack the set of electrodes in a neat rectangular array particularly adopted for displaying a set of characters either in a modular character by character unit as shown in FIG. 1*a* or in a longer multi-character array as shown in FIG. 9.

Alternative conductor wires with sets of parallel disposed straight line conductors in place of the zig-zag conductor pattern also can be used. In particular those arrays of FIGS. 2*a*, 3*a*, 4 and 11 are particularly advantageous in packing aspect ratio and simplicity of access to each coordinate electrode position. Such conductor arrays can afford the additional advantage of fewer than the 5 by 5 matrix wires a, b, c, d, e; v, w, x, y, z to program, as for example, those schematically shown in FIGS, 3, 4 and 11.

Figure 2A:
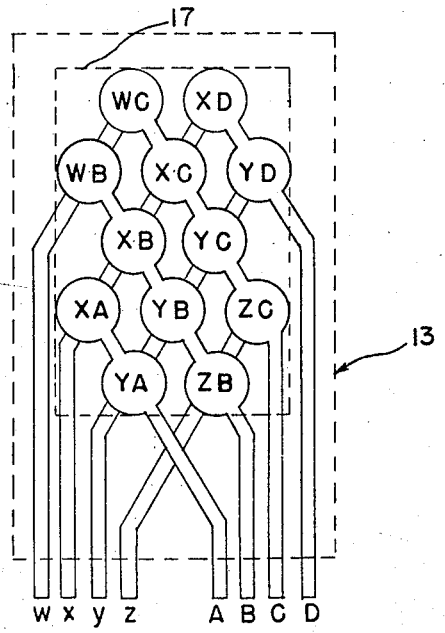
FIG. 2*a* is a sketch showing a twelve electrode pair of adjacent element areas in an array for producing flexible character shapes.
Figure 2B:
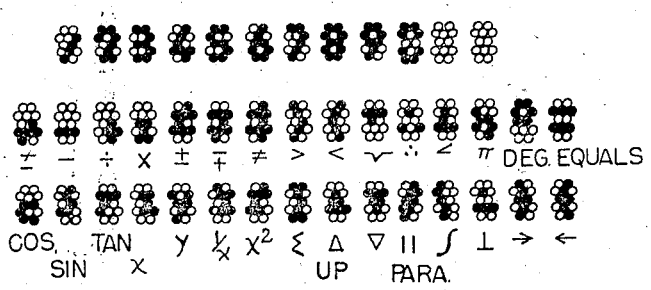
FIG. 2*b* is a representative set of character shapes formed with the array of FIG. 2*a*.

The circular element arrays of FIG. 2*a* have only twelve elements arranged in a pattern selectable from a four by four matrix conductor pattern. A sandwich module 13 with optically active material in the region 17 between electrode pairs 12 can be used for display of a single character or they can be assembled in adjacent character array. This use of so few elements to produce a set of characters and symbols including all the Arabic decimal numerals 0 to 9 as shown in FIG. 2*b*, permits simpler, less costly and less power consuming coding and energization switching circuits. Yet as may be seen by the darkened subsets, because of the triangular disposal of the circular elements, the numerical digits 0 to 9 so formed are unmistakable and pleasant in appearance. Identification of the selected elements for this numerical display pattern is shown in the following table.

| Decimal Digit | Matrix Wire Selections |
|---|---|
| 1 | x, abcd |

-continued

| Decimal Digit | Matrix Wire Selections |
|---|---|
| 2 | w, c |
| | x, d |
| | y, abcd |
| | z, b |
| 3 | w, c |
| | x, bd |
| | y, acd |
| | z, bc |
| 4 | w |
| | x, abcd |
| | y, b |
| | z, bc |
| 5 | w, bc |
| | x, bd |
| | y, ac |
| | z, bc |
| 6 | x, abcd |
| | y, ac |
| | z, bc |
| 7 | w, b |
| | x, c |
| | y, abcd |
| 8 | w, bc |
| | x, abd |
| | y, acd |
| | z, bc |
| 9 | w, bc |
| | x, bd |
| | y, acd |
| 0 | w, abc |
| | x, ad |
| | y, bcd |

Figure 3A:
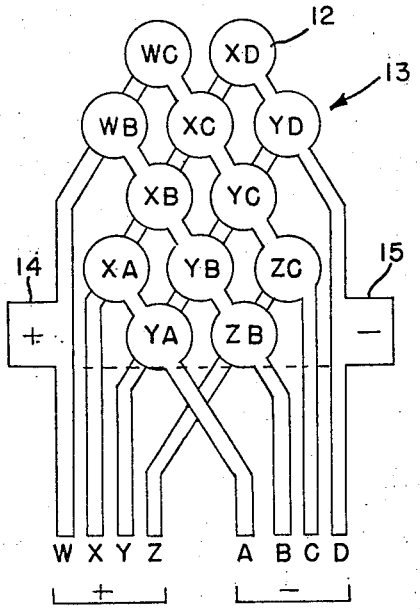
FIG. 3*a* is a variation of the array of FIG. 2*a* providing for a decimal point, as shown in FIG. 3*b* with the display of $\pi$ in 3.1415+ decimal form in five side-by-side modular character forming sets.
Figure 3B:
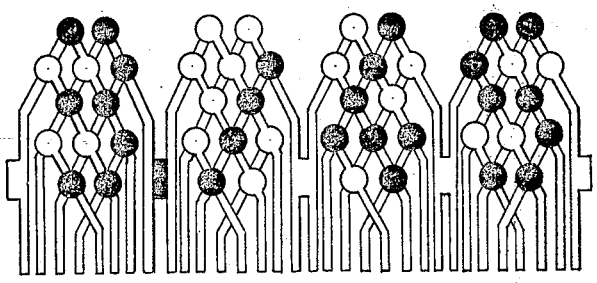

In the embodiment shown in FIGS. 3*a* and 3*b*, provision is made for a decimal point which has two rectangular shaped electrodes 14 and 15 arranged on opposite sides of the material and the set of electrodes so that the decimal point is distinctive in shape and positioned between individual character sets as shown in FIG. 3*b* for $\pi$ (3.1415+). Thus the w and d conductors adjacent character panels 13 on opposite sides of the visually active material need be energized to make a decimal point visually observable. The square shape prevents any confusion with circular electrode areas used in forming characters with electrode pairs 12.

Figure 4:
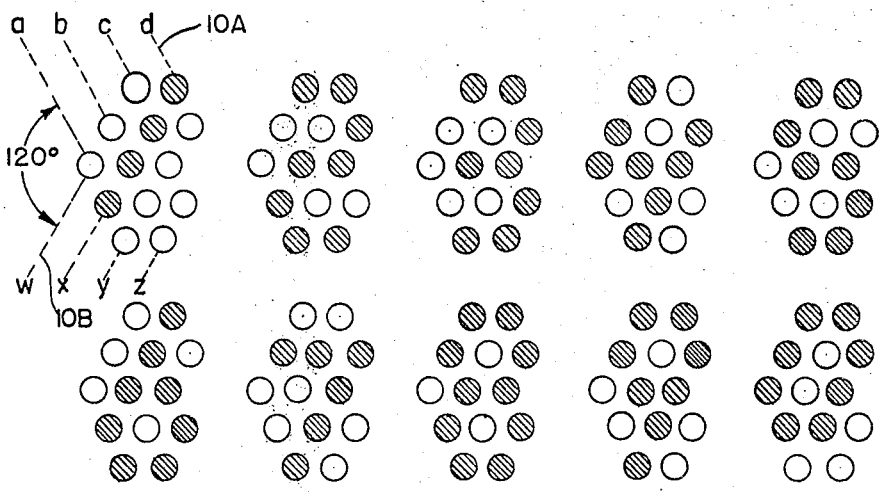
FIG. 4 is a set of sketches showing electrodes in a 13 position array for forming a set of characters including Arabic decimal numerals 0 to 9.
Figure 5:
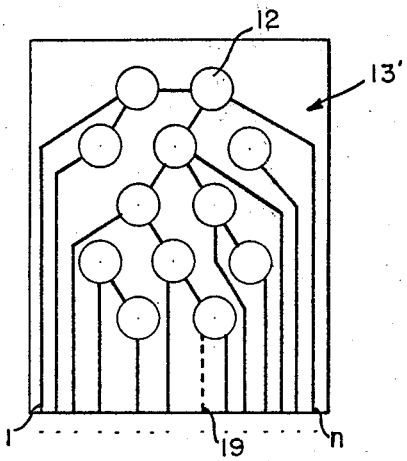
FIG. 5 is a diagrammatic view of a wiring layout for a 12 element array suitable for displaying decimal characters 0 to 9 by selection of individual electrode positions on one side of the display material.
Figure 6:
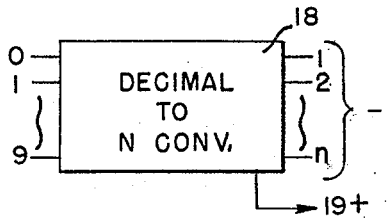
FIG. 6 is a block schematic diagram of a code converter electronic switching circuit actuating different subsets of elements in an array to form decimal characters.

The decimal digit characters formed with a thirteen element array embodiment of element areas is depicted in FIG. 4, where a four by four conductor array a, b, c, d; w, x, y, z is used to select each element coordinate and the linear parallel conductor axes are arranged at a 120° angle to each other.

Where time sharing is not desired or necessary, the embodiment of FIG. 5 may be used in a continuously actuated mode when a decimal to twelve code converter 18 of FIG. 6 connects a potential between a chosen subset of the twelve individual electrodes 12 in the 1–n array and the corresponding single wire array 19 shown in dotted lines on the back of the panel 13 for connecting all those electrodes of the electrode pairs 12 on the back of the panel 13 together in a common circuit leading to the single connector conductor terminal 19. Note that none of the front panel wiring conductors for the electrodes in the set 1 to n and the back panel wiring 19 cross over (overlap) so that the only visually excited areas are the selected circular electrode overlap areas, when a potential is selected for any desired subset of the twelve electrode areas in the said pattern.

Figure 7:
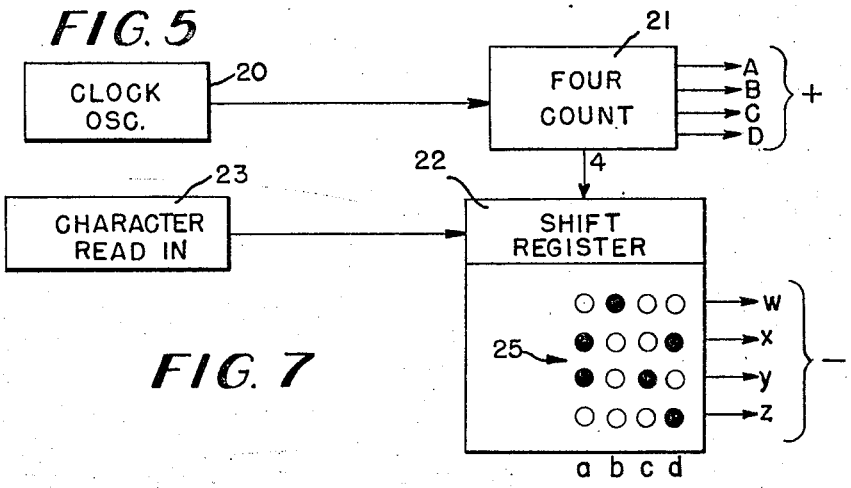
FIG. 7 is a block diagram of a display register embodiment for driving a matrix type display pattern in a time shared mode.

The scanning displays may be programmed for time sharing by conventional memories now available in the low cost miniature computer art or by other programming means such as the shift register array shown in FIG. 7. Therein, the clock oscillator 20 provides a count trigger pulse for four count counter 21 and thus also for shift register 22 at a rate that permits all elements in a visible display to be scanned often enough to appear to the human eye as though the display is continuously energized. This repetition rate is of the order of above about 15 Hz which is a customary rate for showing movie frames, for example. The four count counter 21 scans the matrix conductors a, b, c, d in the case of a four by n matrix array, but is extended to a five count, for example, if a five by n array is used, etc. Thus, the conductors a, b, c, d in sequence are given a positive potential for designating presence of a particular coordinate a, b, c, d in a selected subset of elements, during the four counts of counter 21. When the four count is reached then the shift register 22 is shifted to present a new tier of stored subset selection indicia to the array of w, x, y, z conductors. These conductors for example are given negative potentials to indicate a stored character display pattern as represented by corresponding darker ones of the four elemental dots in the array 25 for each scan. Thus the tiers are shifted through the register 22 periodically to maintain a continuously visible subset pattern on the display panel. The patterns are stored in register 22 by a character readin coding circuit 23 in a conventional manner to program selection of the coordinates desired in a subset for display of selected characters. Thus darkened coordinates ay, az, by, cw, dx, dy would be selected during a four tier shift over sixteen counts of clock 20 and repeated over and over again to display in the sixteen (or fewer such as twelve) available element electrode positions a selected character. It is seen that the size of the register 22 and number of bits processed by the readin circuit 23 are significantly reduced with twelve element displays for example, so that minimized power is used and the pulsing at a very low duty rate will reduce power consumption by the display panel.

Figure 8:
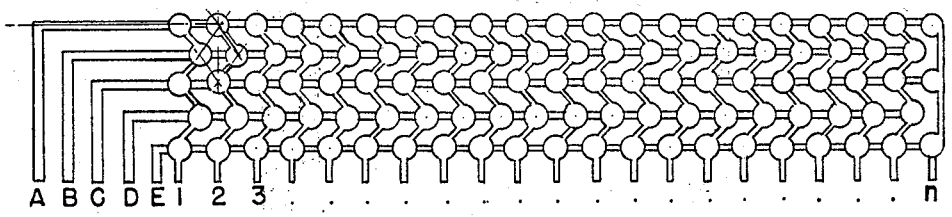
FIG. 8 is a sketch of an extended length multiple character display panel.

In case of an extended display panel length such as shown in FIG. 8, which will display multiple side-by-side characters, the length of shift register 22 is, of course, long enough to store all the desired bits, and in this case a five count a, b, c, d, e in counter 21 and corresponding five bit tier in the shift register 22 would be required to display all coordinate positions in the five rows of electrode positions to be actuated.

As illustrated in FIG. 9, crystal panels 50 may present several side-by-side characters such as the illustrated 210.0123. Because of the possible low contrast of liquid crystal displays, it may be desirable to accent the decimal point 51. This can be done by making it of another contrast exhibiting display device such as a lamp or light emitting diode, which can be viewed through the transparent liquid crystal panel 50 as an auxiliary indicator.

Also another auxiliary indicator could be carried on a movable disc or scroll 52 which presents auxiliary indications 53 or colored panels 54, 55 or a reflective or absorbing background that increases contrast as shown for the decimal character 3 (56) when in a light or dark environment.

Figure 10A:
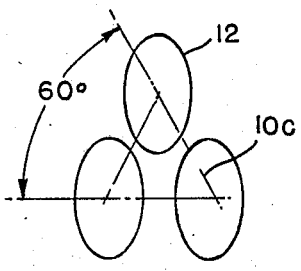
FIGS. 10*a* and 10*b* are sketches showing oval shaped electrodes.
Figure 10B:
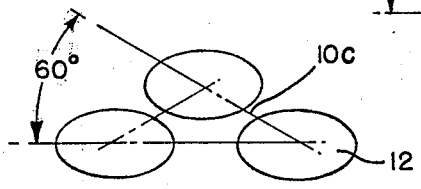

In FIGS. 10*a* and 10*b* respectively oval shaped electrodes 12 are shown together with their effect on the 60° angle set forth in the circular pattern of FIG. 1*a*. The common feature of these different electrode shapes is that in all cases for best character versatility and appearance of a display, the triangular relationship of three adjacent electrodes is isosceles.

Figure 11A:
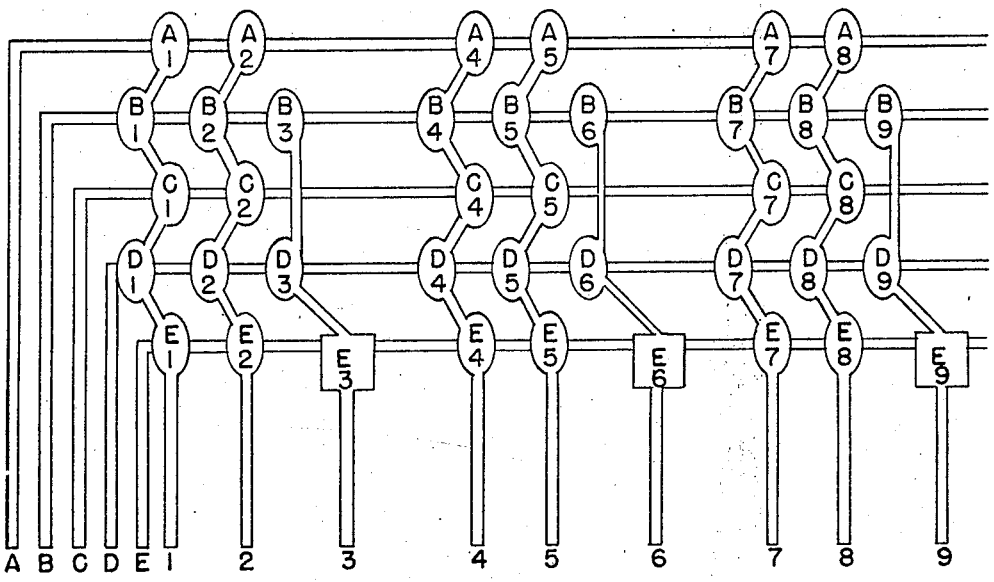
FIG. 11*a* is a sketch of a further embodiment of the invention illustrating a 3 by 5 matrix array having a minimum of matrix selection wires for an array having a good alphameric character selection capabilities, with FIG. 11*b* showing a representative set of characters formed by this matrix with oval shaped electrodes.
Figure 11B:
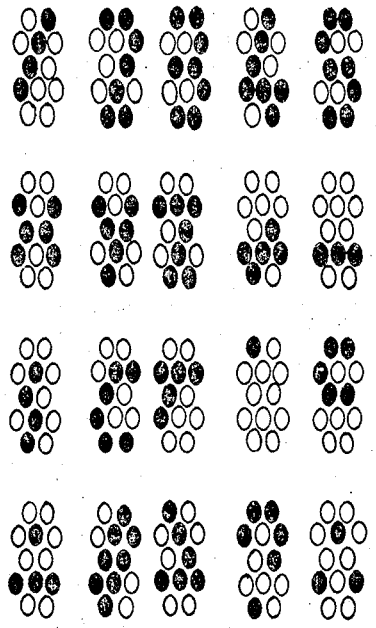

An oval shaped electrode display embodiment is set forth in FIGS. 11*a* and 11*b*. Note that in a side-by-side multiple digit display with common horizontal conductor lines a, b, c, d, e there is a single crossover point of conductors c and 3, 6, 9, etc. which might need to be obscured if an unwanted visual indication appears and it can be masked by painting, etc. as required.

Further advantages of this embodiment are (a) the arrangement of the decimal point and (b) the use of fewer matrix wires (and register storage space) with the 5 by 3 arrangement. Nevertheless this embodiment affords a variety of character patterns as visualized from those of FIG. 11*b*.

The decimal point electrode pair E3, E6, etc. is offset from the character defining set of twelve oval electrodes.

It is seen with reference to FIG. 4 that more characters can be put in a line and less energy can be used to visually display a line of characters in this embodiment because the three columns require fewer steps to complete a line in the time shared mode. For example, if the maximum number of clock pulses in the time sharing mode of operation avoiding visible flicker were 36, then instead of a nine character line, this embodiment could energize a twelve character line. Also, the necessity to step the register fewer times per character saves energy, and the storage capabilities of a shift register of fixed length permit more characters to be stored. Thus, it is seen that this embodiment has particular advantage.

Figure 12A:
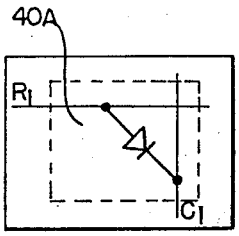
FIG. 12 is a block diagram of a display driver circuit.
Figure 12:
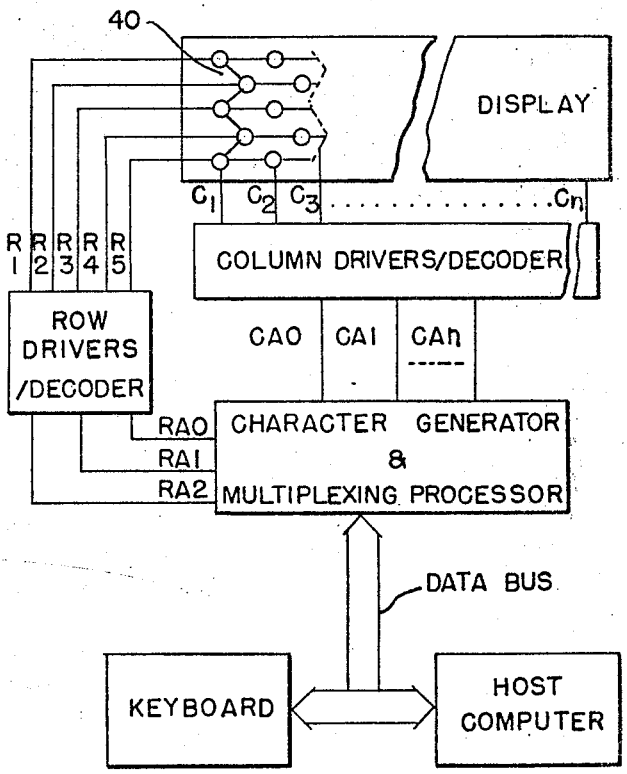

A preferred driving circuit arrangement is shown in block diagram in FIG. 12 where the indicators of this invention providing a visual indication, such as the arrays of FIG. 8 or 11*a*, are typified in the display block. This is a typical scanning display driving circuit afforded to actuate displays in the current state of the art in hand held computers, for example, where each matrix intersection 40 designated by a circle may be an appropriate connection for making a display pattern by emitting light, controlling reflection, etc. As shown in FIG. 12*a* the element is typically a light emitting diode 40A.

The computer-keyboard blocks indicate the control of display information either by manual input or from calculated data within the computer, as synchronized and withdrawn on the data bus to coincide with the appropriate scanning (multiplexing) process as displayed by the appropriate row and column drivers.

INDUSTRIAL APPLICATION

Readily manufacturable and inexpensive electronic numerical digital visual displays with good visible contrast use liquid crystal or plasma panels with a set of generally circular shaped electrodes to display selected numeric and alphanumeric characters in scroll type styling. Provisions are made to operate the displays from short pulses in time sharing mode for low power consumption.

I claim:

1. A display system producing a numerical display from a plurality of discrete electrically actuated element positions in a material exhibiting visibly changeable characteristic, with the positions placed in side-by-side relationship in a crossover grid matrix with the element positions aligned in an array forming a substantially isosceles triangle with each electrode position and two adjacent electrode positions, consisting of a set of electrode positions arranged to present a set of recognizable characters including Arabic numerical digits 0 to 9 with different subsets of said electrode positions and energization means for visually changing said elements comprising opposed electrode pairs defining each element position in said grid, the electrodes being connected in a matrix wiring pattern of separate conductors each connecting a plurality of said element electrodes together and being disposed to actuate an element at a coordinate of two conductors to define each of said discrete element positions when both conductors are energized.

2. The system of claim 1 wherein an array of a plurality of said conductors is arranged in a zig-zag pattern on one side of said material.

3. The system of claim 1 wherein the wiring pattern comprises a set of parallel linear conductors on each of the opposite sides of the material disposed at substantially 120° from each other.

4. The system of claim 3 wherein the wiring pattern for displaying a character consists of a 4 by 4 array of conductors.

5. The system of claims 2 or 3 comprising a modular package for displaying a single character having all the conductors on a panel with the conductors all leading to one edge of the panel.

6. The system defined in claims 2 or 3 wherein the electrodes are generally circular in shape disposed along conductors smaller in width than the diameter of the circular shape.

7. The system defined in claim 6 wherein the material is a plasma producing a cathode glow characteristic disposed between two panels, and the wiring pattern on the opposite sides overlaps only in the circular shaped positions of larger dimensions than the conductors thereby defining the discrete element positions in said grid.

8. The system defined in claim 6 wherein the material is a liquid crystal substance disposed between two panels, and the wiring pattern on the opposite sides overlaps only in the circular shaped positions or larger dimensions than the conductors thereby defining the discrete element positions in said grid visibly distinct in the crystal plane upon electrical actuation.

9. A display system as defined in claim 8 wherein the liquid crystal display elements are contained in a substantially transparent panel, and including at least one selectively actuable auxiliary indicator visible through at least a portion of the panel.

10. A display system as defined in claim 1 wherein said set of element positions consists of no more than thirteen overlapping electrode pairs arranged in said grid to actuate element positions in said grid.

11. A display system as defined in claims 2, 3, 4 or 10 having only twelve overlapping element electrode pairs arranged in said grid to present said characters in subsets of element positions.

12. A display system as defined in claim 1 wherein a set of modular packages are disposed side-by-side for a multiple character display, with at least selected modules presenting an additional decimal point position with two separated electrodes arranged in locations that overlap with a decimal point electrode in an adjacent character display module on either side.

13. A display system as defined in claim 12 wherein the element electrode shapes are circular and the decimal point electrode shape is rectangular.

14. A display system as defined in claim 11 wherein the twelve overlapping electrode pairs are arranged in vertically disposed interlaced rows of overlapping electrode pairs in rows from top downward of 2, 3, 2, 3, 2.

15. A display system as defined in claim 10 having thirteen overlapping electrode pairs arranged in vertically disposed interlaced rows of overlapping electrode pairs in rows from top downward of 2, 3, 3, 3, 2

16. A display system as defined in claims 1, or 2 having twenty-three overlapping electrode pairs in a set of element positions disposed in vertically interlaced rows from top downward of 5, 4, 5, 4, 5.

17. A display system as defined in claim 1 wherein said material is disposed between two panels, and said electrode comprise a commonly connected electrode set disposed on one side of said material and a plurality of discrete electrodes on the other side each having its own conductor leading to one edge of a panel.

18. A display system as defined in claim 17 wherein the conductors to the electrode sets on each side of the material are disposed to overlap only in the position defining an element position in said grid.

19. A system as defined in claim 1 connected with electrical actuating means to display a set of visibly legible characters by establishing a potential change on the electrode pairs defining a subset of said electrode positions in response to selection of the respective characters.

20. A system as defined in claim 19 wherein the electrical actuating means includes code converter means responsive to selected known input character designations to produce a code identifying selection of a subset of the electrode positions in said grid making the selected characters visually recognizable.

21. A system as defined in claim 1 wherein the conductors are arranged in a five by three array producing only eight conductors for energizing the coordinates of each of the electrode positions in said set.

22. A system as defined in claim 1 wherein the conductors are generally oval shaped.

23. A system as defined in claims 1 or 22 having a set consisting of twelve electrodes for reproducing character representations in an array of five rows and three columns with matrix conductors connected with electrodes in each row and column.

24. A system as defined in claim 23 having a decimal point display element offset from the set of twelve electrodes with a pair of decimal point electrodes coupled to one of said row and one of said column conductors respectively.

25. A system as defined in claim 1 arranged in a set of twelve character forming electrode pairs and a thirteenth decimal point forming electrode pair coupled matrix of coordinate conductors in a five row three column array.

* * * * *